US011975896B2

(12) United States Patent
Omdahl, II et al.

(10) Patent No.: US 11,975,896 B2
(45) Date of Patent: May 7, 2024

(54) BEVERAGE CONTAINER LID WITH SELECTABLE DRINKING MODE

(71) Applicant: Runway Blue, LLC, Alpine, UT (US)

(72) Inventors: John R. Omdahl, II, Lindon, UT (US); David O. Meyers, Layton, UT (US); David Bytheway, Springville, UT (US)

(73) Assignee: Runway Blue, LLC, Alpine, UT (US)

( * ) Notice: Subject to any disclaimer, the term of this patent is extended or adjusted under 35 U.S.C. 154(b) by 0 days.

(21) Appl. No.: 17/860,887

(22) Filed: Jul. 8, 2022

(65) Prior Publication Data

US 2023/0029205 A1 Jan. 26, 2023

Related U.S. Application Data

(60) Provisional application No. 63/222,522, filed on Jul. 16, 2021.

(51) Int. Cl.
*B65D 47/28* (2006.01)

(52) U.S. Cl.
CPC ..... *B65D 47/286* (2013.01); *B65D 2231/022* (2013.01); *B65D 2543/00046* (2013.01)

(58) Field of Classification Search
CPC ..... B65D 2543/00046; B65D 47/286; B65D 47/28; B65D 47/26; B65D 2231/022
See application file for complete search history.

(56) References Cited

U.S. PATENT DOCUMENTS

2017/0273484 A1* 9/2017 Spivey ..... A47G 19/2288

FOREIGN PATENT DOCUMENTS

| | | | | |
|---|---|---|---|---|
| FR | 2459762 B1 * | 1/1980 | | |
| FR | 2459762 A1 | 1/1981 | | |
| JP | 3219375 U * | 12/2018 | ..... | B65D 1/24 |
| JP | 3219375 U | 12/2018 | | |
| JP | 6639241 B2 * | 2/2020 | | |
| JP | 6639241 B2 | 2/2020 | | |
| KR | 102096186 B1 | 4/2020 | | |

OTHER PUBLICATIONS

International Search Report and Written Opinion of the International Searching Authority in International Application No. PCT/US2022/036503, dated Oct. 10, 2022, 12 pages.

* cited by examiner

*Primary Examiner* — Javier A Pagan
(74) *Attorney, Agent, or Firm* — Sterne, Kessler, Goldstein & Fox P.L.L.C.

(57) ABSTRACT

A lid for a beverage container having a first drinking opening, a second drinking opening, and a selector. The selector is configured to linearly slide between a first position in which the first drinking opening is accessible and the second drinking opening is inaccessible, and a second position in which the second drinking opening is accessible and the first drinking opening is inaccessible.

25 Claims, 9 Drawing Sheets

BEVERAGE CONTAINER LID WITH SELECTABLE DRINKING MODE

CROSS-REFERENCE TO RELATED APPLICATION

This application claims the benefit of U.S. Provisional Patent Application No. 63/222,522, filed Jul. 16, 2021, which is incorporated herein in its entirety by reference thereto.

FIELD

This disclosure generally relates to lids for beverage containers. More specifically, some embodiments relate to beverage containers with mechanisms for selecting drinking modes.

BACKGROUND

Lids for beverage containers may include a drinking opening for a user to consume a beverage through. Some users may prefer consuming a beverage using a straw. Some users may prefer consuming a beverage without using a straw.

SUMMARY

A lid for a beverage container having a first drinking opening, a second drinking opening, and a selector. The selector is configured to linearly slide between a first position in which the first drinking opening is accessible and the second drinking opening is inaccessible, and a second position in which the second drinking opening is accessible and the first drinking opening is inaccessible.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
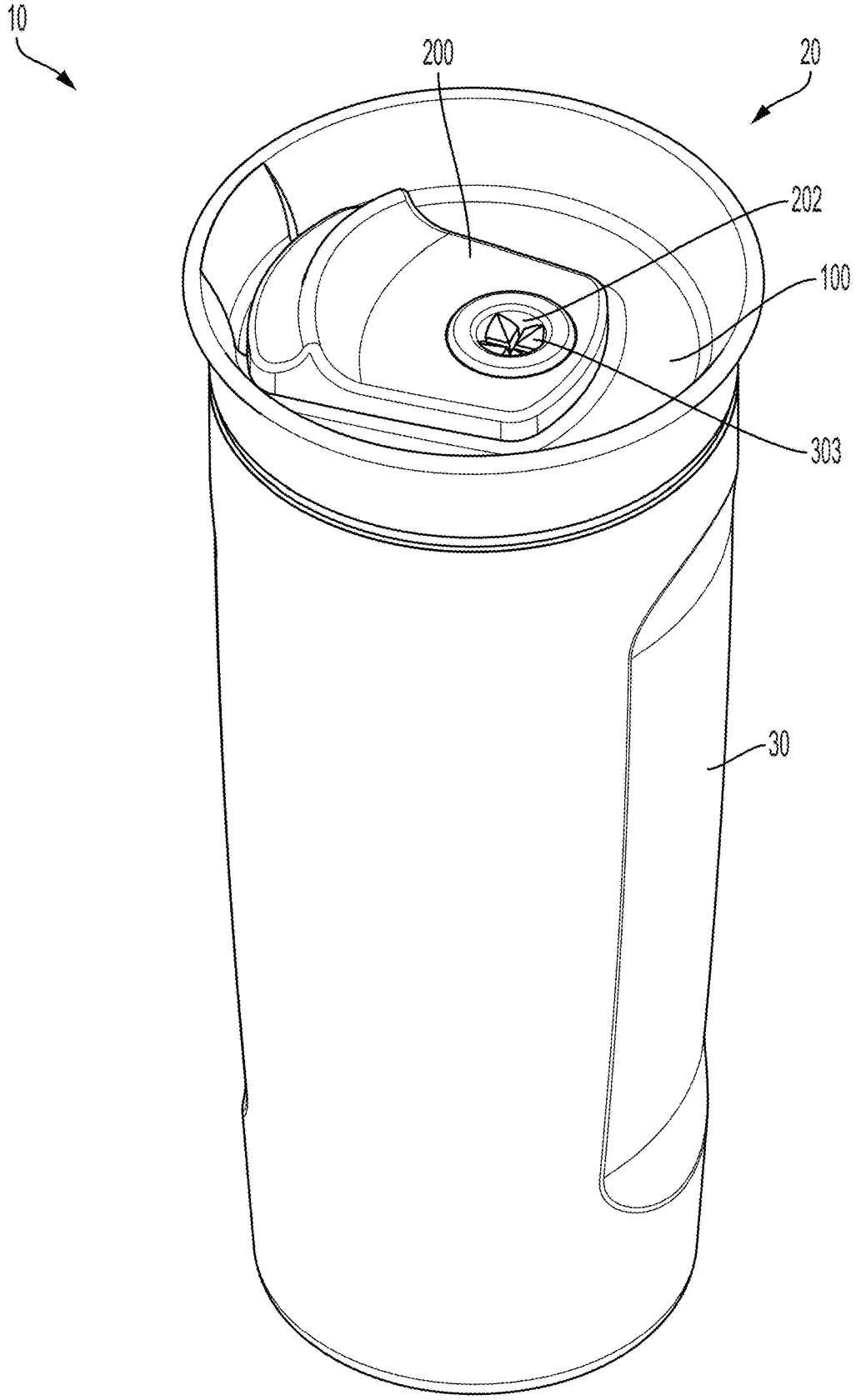
FIG. 1 shows an upper perspective view of a beverage container.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, components, and elements have not been described in detail to avoid unnecessarily obscuring aspects of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, this disclosure has been prepared such that when a particular feature, structure, or characteristic is described in connection with an embodiment, it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable beverage containers to carry a variety of beverages, and some people may have different preferences as to how they drink different beverages. For example, the same person may like to drink their iced tea through a straw and also may like to drink their water by sipping it without a straw. This has often meant that that person needed two different types of beverage containers to transport their beverages, according to which type of beverage they were transporting. Or that person had to drink a beverage in a way that they do not prefer.

Some embodiments of the present disclosure provide a single beverage container that can be used both to drink a beverage through a straw and to drink a beverage without a straw, using the same lid. A person can thus rely on a single container having a single lid for drinking according to either preference. As will be described in more detail below, the exemplifying beverage container illustrated herein has a lid with a selector that slides between a first position and a second position. When the selector is in a first position, a drinking opening through the lid is accessible, and the user can insert a straw through the drinking opening of the lid and suck a beverage up through the straw. When the selector is in the second position, another drinking opening of the lid is accessible, and the user can tilt the beverage container to pour a beverage out of the other drinking opening.

These and other embodiments are discussed below in more detail with reference to the figures.

FIGS. 1-4 show a beverage container 10 according to some embodiments. Beverage container 10 may include a lid 20 and a vessel 30. Lid 20 may include multiple components, including lid base 100 and selector 200.

Lid base 100 may include a drinking opening 102 (shown, for example, in FIG. 5) and a drinking opening 104. Selector 200 may include an opening 202. Selector 200 may be movable (e.g., linearly slidable) relative to lid base 100 between a first position (shown, for example, in FIGS. 1 and 2) and a second position (shown, for example, in FIG. 3).

Figure 2:
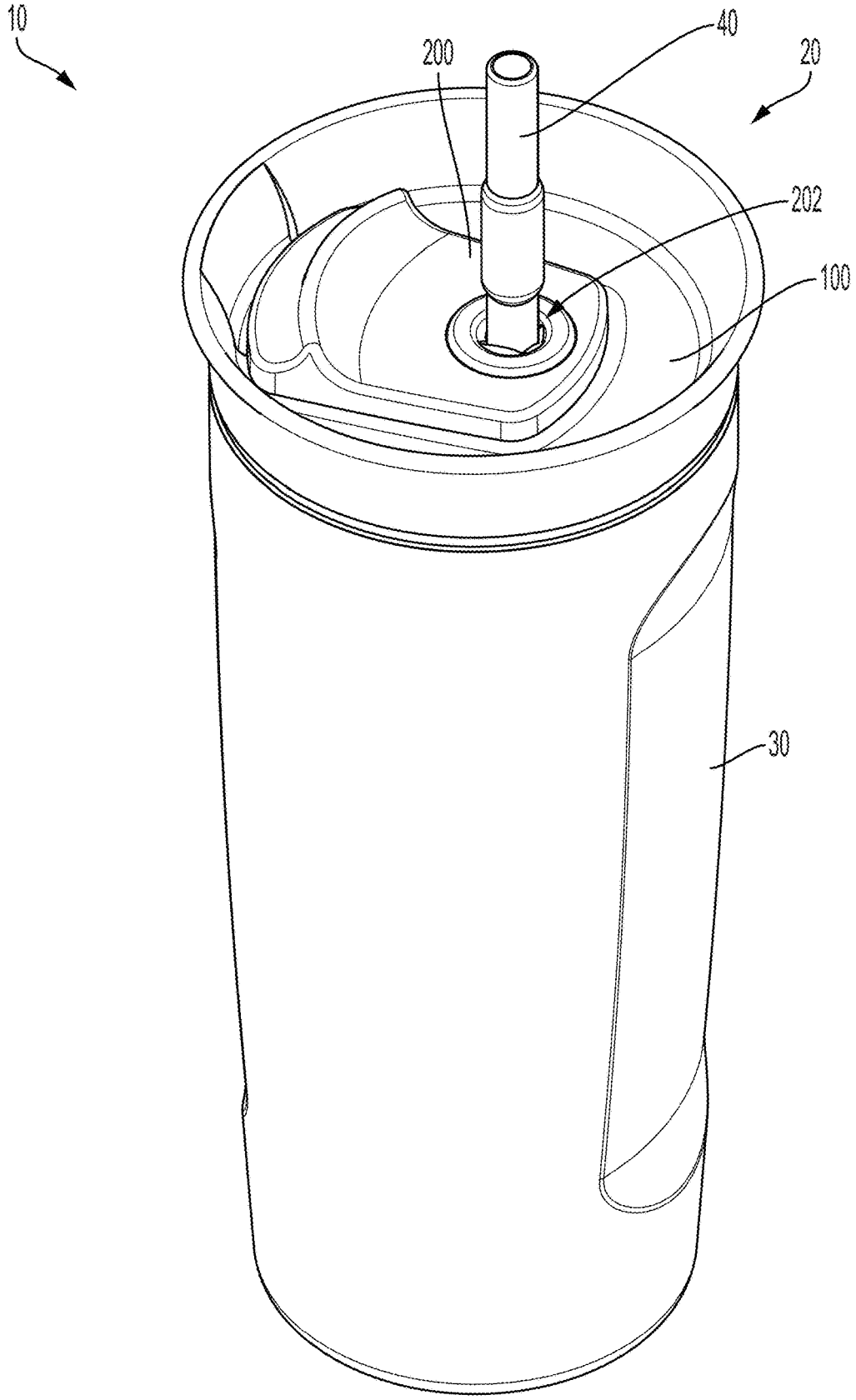
FIG. 2 shows an upper perspective view of the beverage container of FIG. 1 with the selector in a first position and with a straw inserted through the first drinking opening.

When selector 200 is in its first position, as shown in FIG. 2, drinking opening 102 may be accessible (for example, through opening 202 of selector 200) and drinking opening 104 may be inaccessible (for example, due to the positioning of selector 200 over drinking opening 104). In some embodiments, when selector 200 is in its first position, opening 202 may align with drinking opening 102 such that a user may insert a straw 40 through opening 202 and drinking opening 102. In such embodiments, when lid 20 is assembled with vessel 30 and selector 200 is in its first position, a user may dispense a beverage contained within vessel 30 through straw 40 through opening 202 and drinking opening 102. In some embodiments, when selector 200 is in its first position, selector 200 is positioned over and seals drinking opening 104. The term seal as used here and elsewhere in this document does not necessarily require a perfect hermetic seal; rather a seal capable of inhibiting passage of liquid fluid is sufficient.

In some embodiments, lid 20 includes a valve 303 positioned at opening 202. When valve 303 is closed, valve 303 may seal against the passage of liquid from an interior of beverage container 10 to the outside of beverage container 10. Valve 303 may be easily opened in the opposite direction, allowing, for example, a straw 40 to be inserted through opening 202. Valve 303 may be or include a one-way valve, for example, a duckbill valve, a cross-slit valve, a diaphragm valve, a swing check valve, or a perforated membrane. In some embodiments, valve 303 may be positioned at drinking opening 102 instead of at opening 202.

Figure 3:
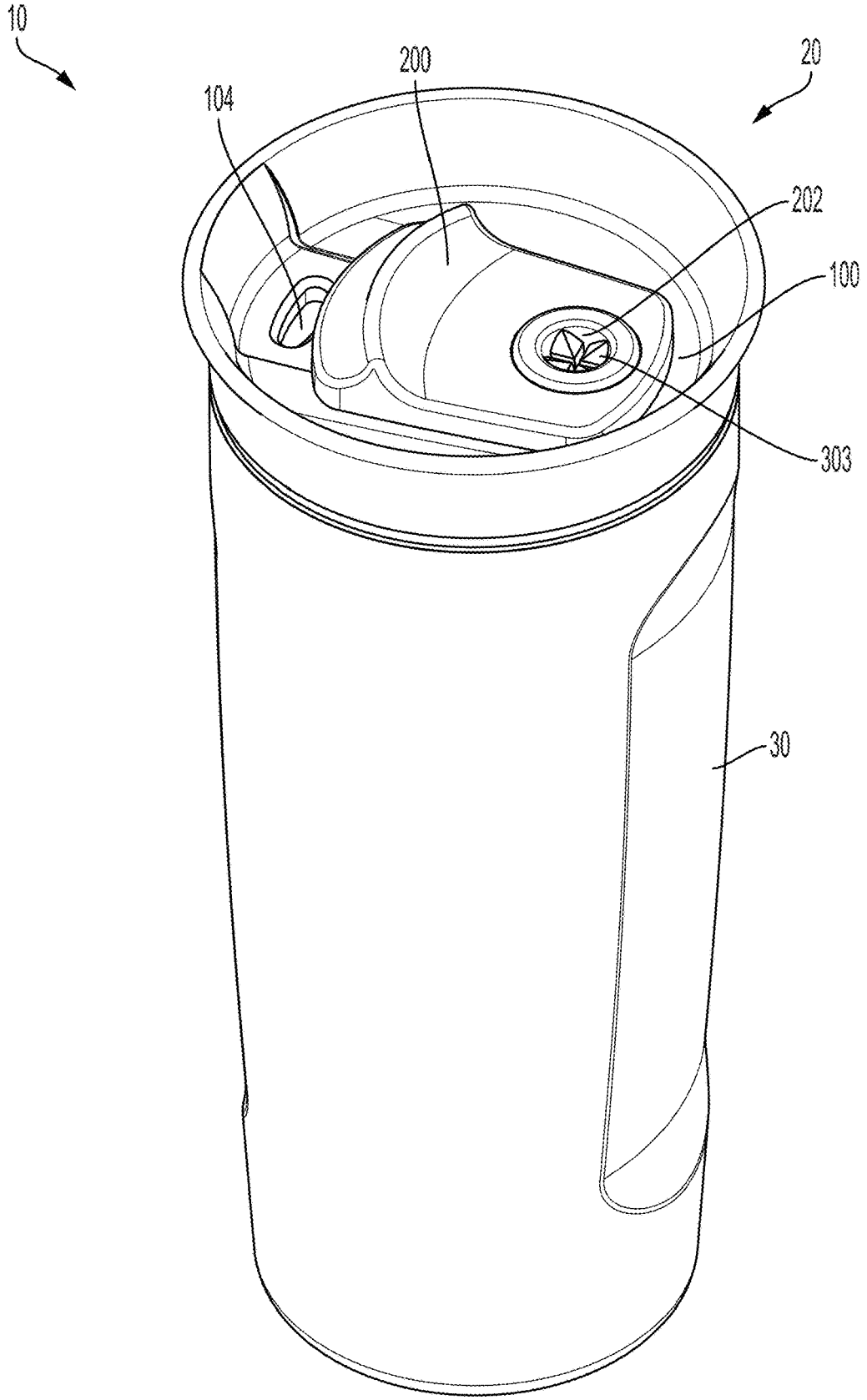
FIG. 3 shows an upper perspective view of the beverage container of FIG. 1 with the selector in a second position.
Figure 4:
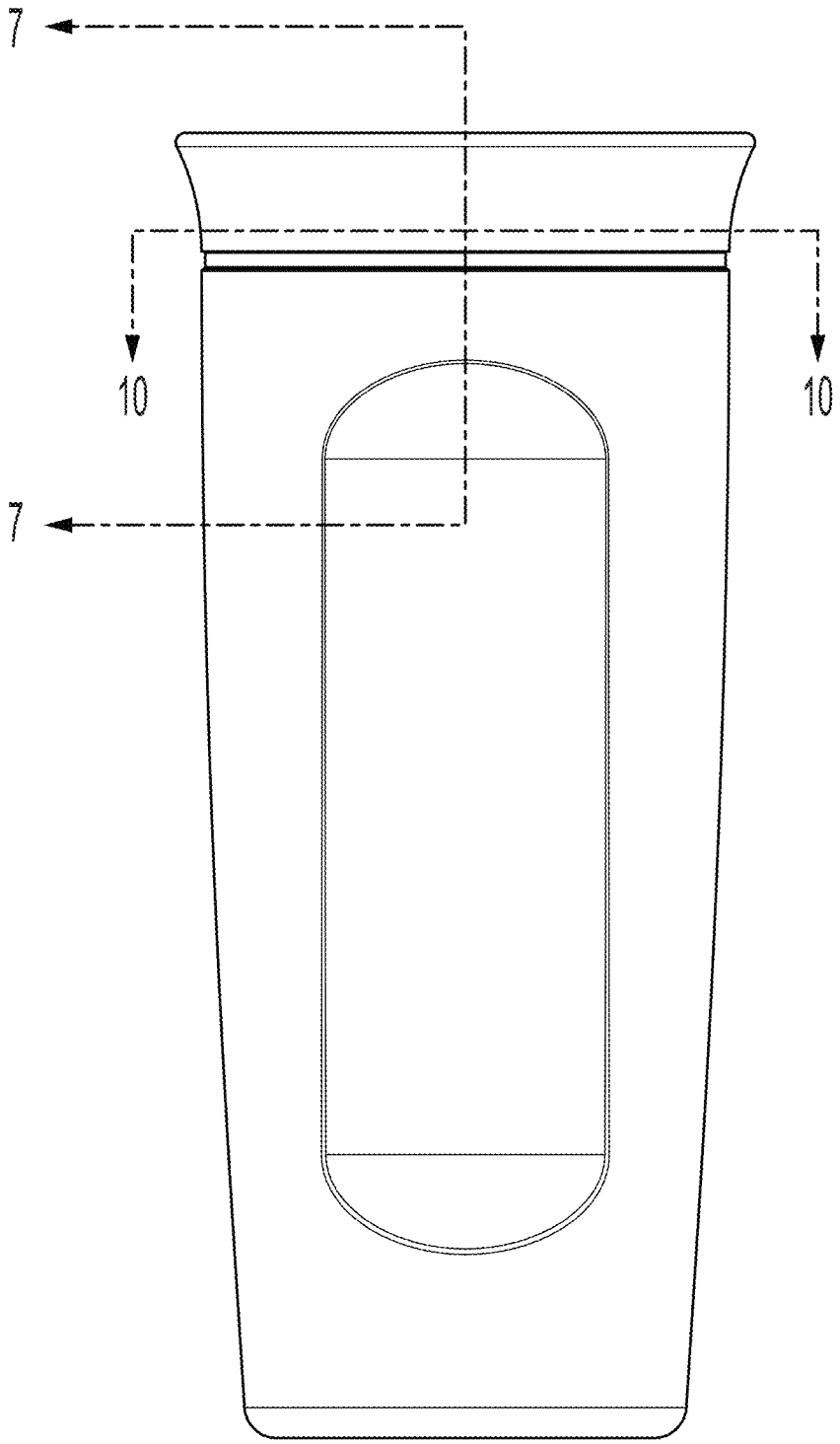
FIG. 4 shows a front view of the beverage container of FIG. 1.

If the user does not prefer to drink the beverage through a straw, the user can move (e.g., linearly slide) selector 200 relative to lid base 100 to a second position represented in FIG. 3. A user may, for example, slide selector 200 relative to lid base 100 in a direction perpendicular to an axis of drinking opening 102 to move selector 200 from its first position to its second position. Linearly sliding selector 200 relative to lid base 100—rather than, for example, a rotational movement—may allow a user to more easily move a selector relative to a lid base with one hand. Further, by using a linear sliding arrangement, an axis of rotation (and associated structure) is not needed, which can simplify construction of lid 20 and, in some embodiments, separation of selector 200 from lid base 100 for disassembly.

As shown in FIG. 3, when selector 200 is in its second position, drinking opening 104 may be accessible. Accordingly, when lid 20 is assembled with vessel 30, a user may dispense a beverage contained within vessel 30 through drinking opening 104 by tilting beverage container 10 toward drinking opening 104. In some embodiments, when selector 200 is in its second position selector 200 may be positioned away from drinking opening 104. Also as shown in FIG. 3, when selector 200 is in its second position, drinking opening 102 may be inaccessible (for example, due to the positioning of selector 200 over drinking opening 102). Accordingly, when lid 20 is assembled with vessel 30, a user may not be able to dispense a beverage contained within vessel 30 through drinking opening 102. In some embodiments, when selector 200 is in its second position, opening 202 may be offset from drinking opening 102 such that straw 40 cannot be inserted through opening 202 and drinking opening 102.

In some embodiments, selector 200 can be removed from lid base 100. This may for example, allow a user to more easily clean lid 20 and its components. In some embodiments, selector 200 can be removed from lid base 100 by sliding (e.g., linearly) selector 200 relative to lid base 100. In the illustrated embodiment, selector 200 is removable from lid base 100 by sliding selector 200 past its second position (i.e., by continuing to slide selector 200 in the same direction it moves between its first position and its second positon). However, selector 200 may be removable from lid base 100 by sliding selector 200 in a different direction.

FIGS. 5-11 show detailed views of an embodiment for implementing some features as have been described. The specific structures and mechanisms shown and described (here and anywhere else in this document) may not be the only way to accomplish the functions described, and each element may be implemented using other shapes, structures, and appearances than specifically shown and described.

Figure 5:
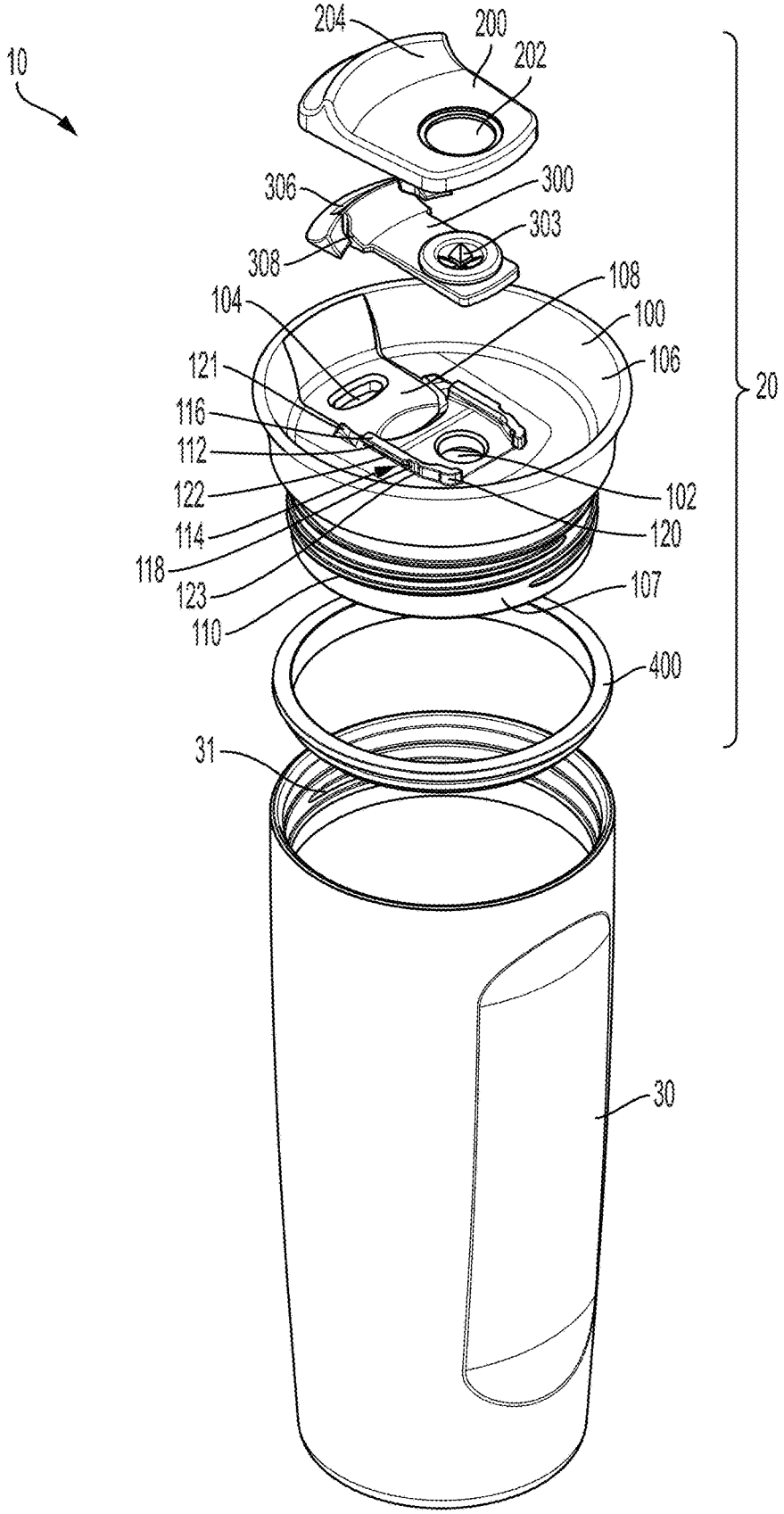
FIG. 5 shows an exploded upper perspective view of the beverage container of FIG. 1.
Figure 6:
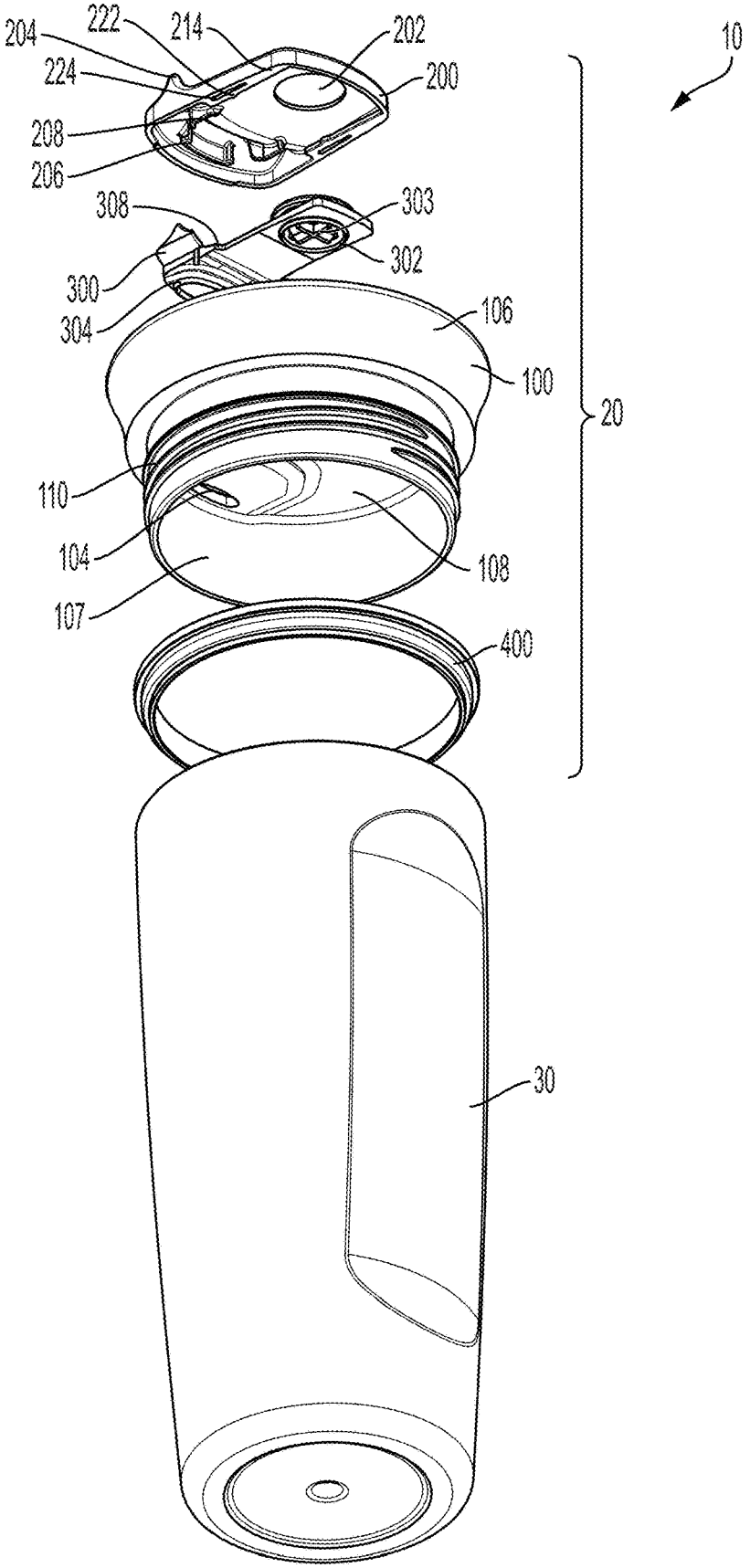
FIG. 6 shows an exploded lower perspective view of the beverage container of FIG. 1.

FIGS. 5 and 6 show exploded views of beverage container 10 according to some embodiments. As shown, lid 20 includes lid base 100, selector 200, a sealing member 300, and a gasket 400. Container 10 may also include a vessel 30.

As shown in FIGS. 5 and 6, lid base 100 may include an upper rim 106, a lower side wall 107, and a dividing platform 108.

Drinking opening 102 and drinking opening 104 may extend through dividing platform 108. In the illustrated embodiment, drinking opening 102 has a circular shape, and drinking opening 104 has a stadium shape. However, drinking opening 102 and drinking opening 104 each may have any other suitable shape. When lid 20 is assembled with vessel 30, a user may drink a beverage contained within container 10 thorough drinking opening 102 or drinking opening 104.

In some embodiments, drinking opening 102 may be positioned at or near a center of lid 20. For example, drinking opening 102 may be nearer to a center of lid 20 than it is to an outer edge of lid 20, or drinking opening 102 may be nearer to the center than drinking opening 104 is to the center. This positioning may allow a user to comfortably drink from straw 40 extending through drinking opening 104 when selector 200 is in its first position. In some embodiments, drinking opening 104 may be positioned near an outer edge of lid 20 (for example, near upper rim 106). For example, drinking opening 104 may be nearer to the outer edge than it is to a center of lid 20, or drinking opening 104 may be nearer to the outer edge than drinking opening 102 is to the outer edge. This positioning may, for example, allow a user to comfortably drink from an edge of lid 20 (for example, upper rim 106) by tilting container 10 toward drinking opening 104 when selector 200 is in its second position. Again, this positioning may allow a user to comfortably drink from straw 40 extending through drinking opening 104 when selector 200 is in its first position and to comfortably drink from an edge of lid 20 by tilting container 10 toward drinking opening 104 when selector 200 is in its second position.

Lid base 100 may include an attachment mechanism 110 on a lower side wall 107 of lid base 100. Vessel 30 may include a corresponding attachment mechanism 31 near an upper edge of the vessel, configured to engage with attachment mechanism 110 to removably attach vessel 30 to lid 20. Attachment mechanisms 110 and 31 may be threaded connectors (as shown in FIGS. 5 and 6), friction fit connectors, snap-fit connectors, or any other suitable releasable attachment mechanism. The attachment of lid base 100 to vessel 30 is not limited to the arrangement shown in the figures. For example, in some embodiments, lid base 100 may attach over vessel 30 rather than inside vessel 30.

Gasket 400 may fit around lower side wall 107 of lid base 100. When lid 20 is assembled with vessel 30, gasket 400 may be pressed between lid base 100 and an inner surface of vessel 30 to create a seal between lid 20 and vessel 30. Gasket 400 may be a removable component or may be an integrally-formed part of lid base 100 or vessel 30.

As shown in FIGS. 5 and 6 (and enlarged in FIG. 9), lid base 100 may include an engagement structure 112 extending from dividing platform 108. Engagement structure 112 may be formed to receive cooperating features of selector 200 to help selector 200 move with respect to lid base 100 and/or maintain its position with respect to lid base 100.

In some embodiments, lid base 100 may include stops 120, 121 to restrain movement of selector 200 relative to lid base 100. In some embodiments, lid 20 may include registration features to hold selector 200 in either its first position or second position. In some embodiments, registration features may also provide tactile and/or audible feedback to a user when sliding selector 200 to help a user know when beverage container 10 is in a particular mode.

Lid base 100 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece or as multiple pieces.

As mentioned, selector 200 is attachable to and movable (for example, linearly slidable) relative to lid base 100. Selector 200 may include a grip 204 to which a user may apply a force to move selector 200 from its first position to its second position, or from its second position to its first position. In some embodiments, and as will be discussed in greater detail, a user may also apply a force to grip 204 to move selector 200 to a disassembly position.

Selector 200 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), or metal (e.g., steel, stainless steel, aluminum, copper, or titanium), and may be formed as a single, unitary piece or as multiple pieces.

As shown in FIGS. 5 and 6, lid 20 may include a sealing member 300 located between selector 200 and lid base 100 when lid 20 is assembled.

As will be discussed in greater detail, sealing member 300 may include a sealing portion 302 to seal drinking opening 102 and/or opening 202, and a sealing portion 304 to seal drinking opening 104. In the illustrated embodiment, sealing portion 302 and sealing portion 304 are part of a single component. However, sealing portion 302 and sealing portion 304 may be or be part of separate components.

When lid 20 is assembled, sealing member 300 (including sealing portion 302) may be attached to and move together with selector 200 relative to lid base 100. In such embodiments, selector 200 and sealing member 300 may include attachment structures to attach sealing member 300 to selector 200. In the illustrated embodiment, for example, selector 200 includes a flange 206 (shown in FIG. 6), and sealing member 300 includes a complementary pocket 306 (shown in FIG. 5) to engage with and hold flange 206.

In some embodiments, selector 200 and sealing member 300 may include structures to stabilize selector 200. For example, in the illustrated embodiment, selector 200 includes brackets 208 (shown in FIG. 6) to engage with complementary portion 308 of sealing member 300 in order to restrain rotation of selector 200 relative to sealing member 300.

In the illustrated embodiment, sealing member 300 (including sealing portion 302 and sealing portion 304) is formed separately from lid base 100 and selector 200. However, sealing portion 302 may be formed integrally with lid base 100 or selector 200 (for example, through co-molding), and sealing portion 304 may be formed integrally with selector 200 (for example, through co-molding).

Sealing portion 302 may be formed of a food-grade material suitable to seal drinking opening 102 and/or drinking opening 202. For example sealing portion 302 may be formed of silicone or another flexible, resilient material. Sealing portion 304 may be formed of a food-grade material suitable to create a seal between lid base 100 and selector 200. For example sealing portion 302 may be formed of silicone or another flexible, resilient material.

Vessel 30 may be any type of container. Vessel 30 may be generally cylindrical or frustoconical (e.g., a tumbler-style container, as shown, for example, in FIGS. 1-6) or have another exterior or interior shape. In some embodiments, vessel 30 may be double-walled to enhance thermal insulative properties of vessel 30. In some embodiments, an area between vessel 30's double walls may be hermetically sealed and may form at least a partial vacuum. In some embodiments, vessel 30 may be formed of stainless steel. In some embodiments, vessel 30 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

When container 10 is assembled and selector 200 is in its first position with straw 40 inserted through drinking opening 102, a bottom end of straw 40 may extend to or near an interior bottom surface of vessel 30. Straw 40 may be formed of a food-grade material. For example, straw 40 may be formed of a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

Figure 7:
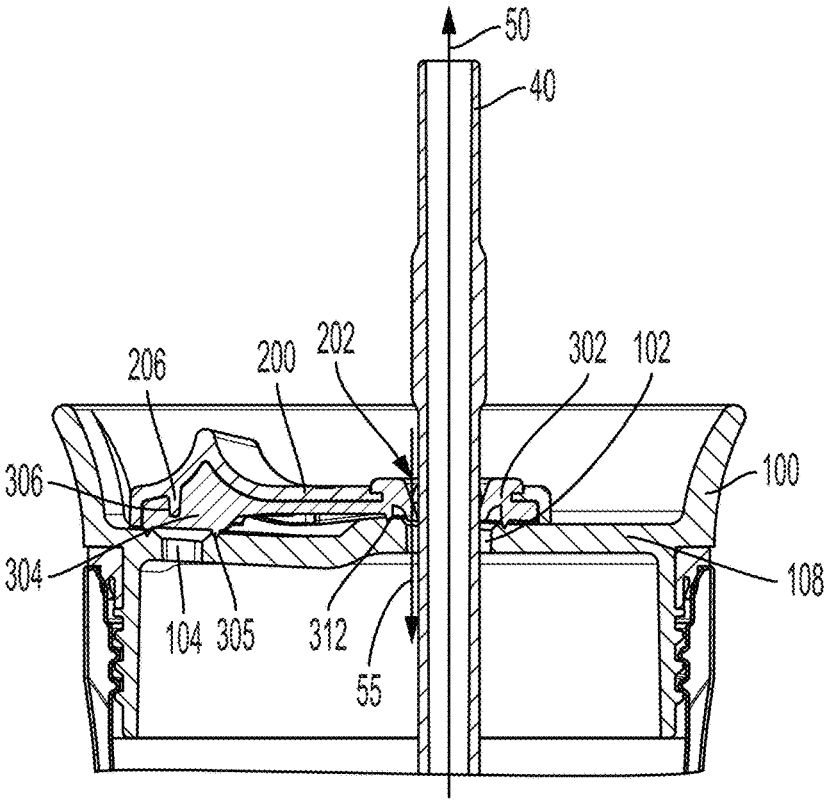
FIG. 7 shows a sectional view of a portion of the beverage container of FIG. 1 taken along line 7-7 of FIG. 4 with the selector in the first position and with a straw inserted through the first drinking opening.
Figure 8:
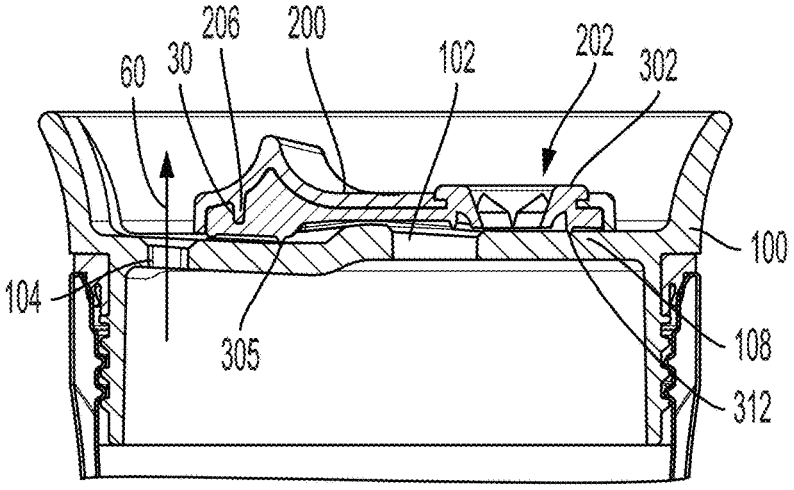
FIG. 8 shows a sectional view of a portion of the beverage container of FIG. 1 taken along line 7-7 of FIG. 4 with the selector in the second position.

FIGS. 7 and 8 are vertical cross-sectional views showing relative positions of certain components of beverage container 10 during operation. These figures illustrate portions of lid base 100, selector 200, and sealing member 300 (including sealing portion 302 and sealing portion 304) when selector 200 is in its first position (FIG. 7) and its second position (FIG. 8).

In FIG. 7, selector 200 is in its first position relative to lid base 100. In this position, opening 202 of selector 200 is aligned with drinking opening 102 of lid base 100. Accordingly, a user may insert a straw 40 through opening 202 and drinking opening 102 to dispense a beverage contained within vessel 30 through straw 40, as shown by arrow 50. Also in this position, selector 200 is positioned over drinking opening 104, thereby inhibiting a beverage from being dispensed through drinking opening 104.

In some embodiments, lid 20 includes sealing portion 302, which may be or include a one-way valve 303. Sealing portion 302 may be part of a separate component (e.g., sealing member 300) attached to selector 200 or may be integrally formed as part of selector 200. In embodiments in which sealing portion 302 is or is part of sealing member 300 separate from selector 200, sealing member 300 may be restrained in position relative to selector 200 such that sealing member 300 slides along with selector 200 relative to lid base 100. For example, in the illustrated embodiment, brackets 208 of selector 200 and portions 308 of sealing member 300 may cooperate to restrain movement of selector 200 relative to lid base 100.

In some embodiments, sealing portion 302 may instead be integrally formed as part of lid base 100 or may be or be a part of a separate component attached to and fixed in position relative to lid base 100.

When selector 200 is in its first position, sealing portion 302 may be positioned at drinking opening 102 to seal drinking opening 102. Sealing portion 302 may have any shape and configuration sufficient to seal drinking opening 102 yet allow a straw 40 to be inserted therethrough. For example, as illustrated in FIG. 7, sealing portion 302 may include protrusion 312, which contacts lid base 100 around a periphery of drinking opening 102 when selector 200 is in the first position and may also include a one-way valve 303 to allow straw 40 to be inserted therethrough. For illustrative purposes, protrusion 312 and lid base 100 are shown interfering in FIG. 7. However, in reality, protrusion 312 and/or lid base 100 would resiliently deform so that protrusion 312 would be pressed against lid base 100, thereby creating a seal between protrusion 312 and lid base 100. While the illustrated valve is a cross-slit valve, any type of valve suitable to seal against the passage of liquid from an interior of container 10 to the outside of container 10 may be used.

In some embodiments, when selector 200 is in its first position and straw 40 is inserted through opening 202 and drinking opening 102, air can flow from outside container 10, through opening 202 and drinking opening 102 and into interior of container 10. In the illustrated embodiment, for example, valve 303 does not completely seal against straw 40 when straw 40 is inserted therethrough, thereby allowing air to flow through opening 202 and drinking opening 102 around straw 40 and into container 10, as shown by arrow 55. In some embodiments, air may be able to flow from outside container 10 into container 10 via another opening provided in lid base 100. The ability of air to flow from outside container 10 to inside container 10 may help keep a steady flow of liquid through straw 40 and minimize vacuum buildup that could interrupt the flow.

Alternatively or additionally, lid 20 may include sealing portion 304, which may be or include a gasket or plug. Sealing portion 304 may be or be a part of a separate component attached to selector 200 or may be integrally formed as part of selector 200. When selector 200 is in its first position, sealing portion 304 may be positioned at drinking opening 104 to seal drinking opening 104. Sealing portion 304 may have any shape and configuration sufficient to seal drinking opening 104. For example, as illustrated in FIG. 7, when selector 200 is in the first position, protrusion 305 of sealing portion 304 may contact lid base 100 around a periphery of drinking opening 104, thereby sealing drinking opening 104. For illustrative purposes, protrusion 305 and lid base 100 are shown interfering in FIG. 7. However, in reality, protrusion 305 and/or lid base 100 would resiliently deform so that protrusion 305 would be pressed against lid base 100, thereby creating a seal between protrusion 305 and lid base 100.

In the illustrated embodiment, sealing portion 302 and sealing portion 304 are part of a single component. However, sealing portion 302 and sealing portion 304 may be or be a part of separate components.

As mentioned, if the user does not prefer to drink the beverage through a straw, the user can move (e.g., linearly slide) selector 200 relative to lid base 100 to a second position represented in FIG. 8.

In FIG. 8, selector 200 is in a second position relative to lid base 100. In the illustrated embodiment, when selector 200 is in this position, selector 200 is positioned away from drinking opening 104. Accordingly, a user may dispense a beverage contained within vessel 30 through drinking opening 104, as shown by arrow 60, by tilting container 10 toward drinking opening 104. In this position, opening 202 is offset from drinking opening 102 such that straw 40 cannot be inserted through opening 202 and drinking opening 102.

In some embodiments, when selector 200 is in its second position, air can flow from outside container 10, through drinking opening 102, and into interior of container 10. In some embodiments, for example, air can flow from outside container 10, through an area between selector 200 and lid base 100, through drinking opening 102, and into container 10. In the illustrated embodiment, for example, sealing portion 302 does not seal drinking opening 102 when selector 200 is in its second position, and thus air can flow from outside container 10, through an area between selector 200 and lid base 100, through drinking opening 102, and into container 10. In some embodiments, opening 202 is positioned partially above drinking opening 102 so that air can flow from outside container 10, through opening 202 and drinking opening 102, and into container 10. In some embodiments, air may be able to flow from outside container 10 to inside container 10 via opening 202 and another opening provided in lid base 100 other than drinking opening 102. In some embodiments, air may be able to flow from outside container 10 to inside container 10 via another opening provided in lid base 100 other than drinking opening 102. The ability of air to flow from outside container 10 to inside container 10 may help keep a steady flow of liquid through drinking opening 104 and minimizes vacuum buildup that could interrupt the flow.

Figure 9:
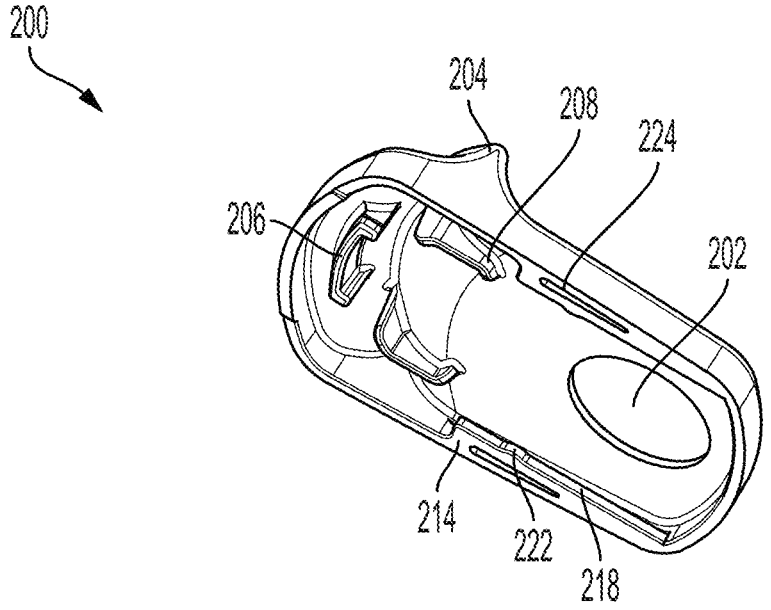
FIG. 9 shows an exploded view of the selector and the lid base of the beverage container of FIG. 1.
Figure 9:
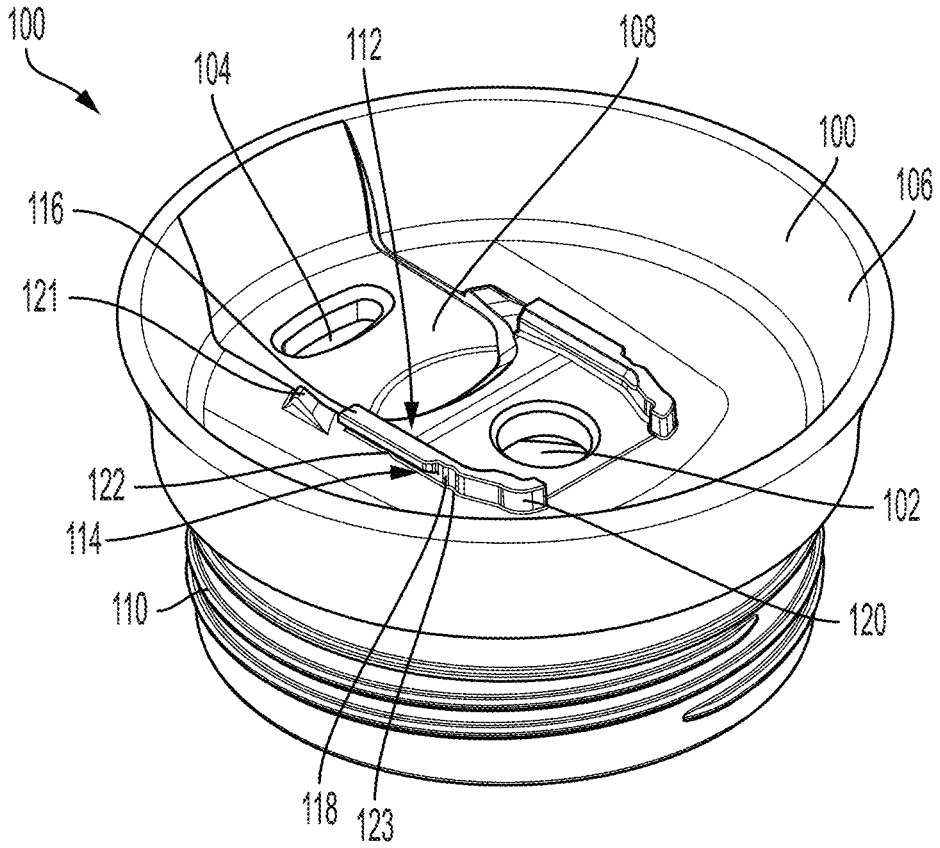

FIG. 9 shows an enlarged view of selector 200 and lid base 100. As mentioned, lid base 100 may include an engagement structure 112 extending from dividing platform 108. Engagement structure 112 may be formed to receive cooperating features of selector 200 to help selector 200 move with respect to lid base 100 and/or maintain its position with respect to lid base 100.

For example, engagement structure 112 of lid base 100 may define a pair of receiving channels 114, which receive a pair of flanges 214 of selector 200. In some configurations, when lid 20 is assembled, top panels 116 of receiving channels 114 may be positioned above flanges 214, thereby inhibiting selector 200 from moving vertically relative to lid base 100. Additionally, in some configurations, sides 118 of receiving channels 114 may be positioned adjacent to sides 218 of flanges 214, thereby inhibiting selector 200 from rotating relative to lid base 100. The engagement of lid base 100 and selector 200 is not limited to the arrangement shown in the figures. For example, in some embodiments, selector 200 may include receiving channels to receive flanges of lid base 100.

As will be discussed in greater detail, in some embodiments, lid base 100 may include stops 120, 121 to restrain movement of selector 200 relative to lid base 100.

Also as will be discussed in greater detail, lid 20 may include registration features to hold selector 200 in either its first position or second position. For example, in the illustrated embodiment, engagement structure 112 includes recesses 122, 123, which receive registration bumps 222 of selector 200. In some embodiments, registration features may also provide tactile and/or audible feedback to a user when sliding selector 200 to help a user know when beverage container 10 is in a particular mode.

Figure 10:
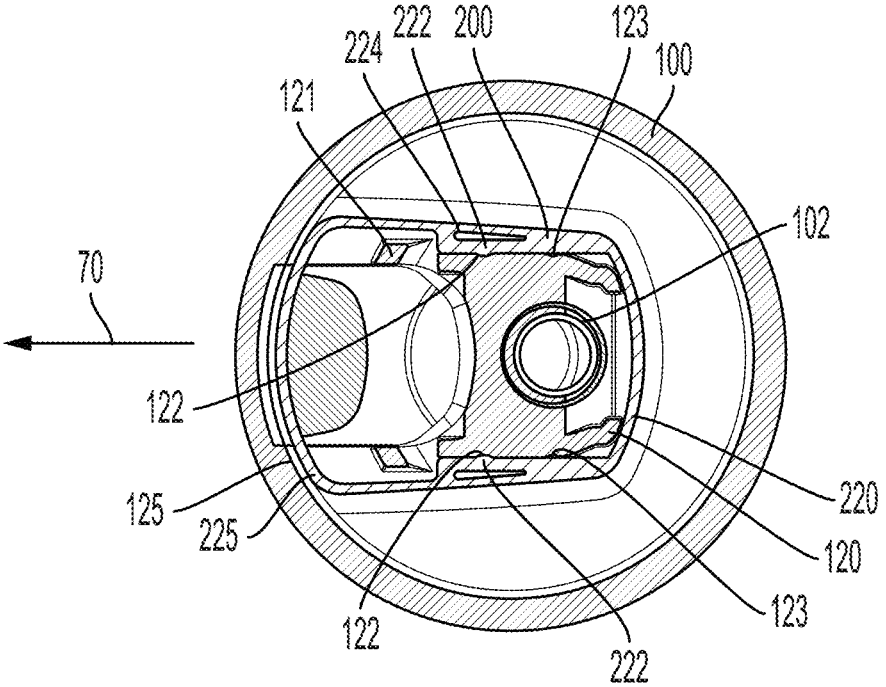
FIG. 10 shows a sectional view of a portion of the beverage container of FIG. 1 taken along line 10-10 of FIG. 4 1 with the selector in the first position.
Figure 11:
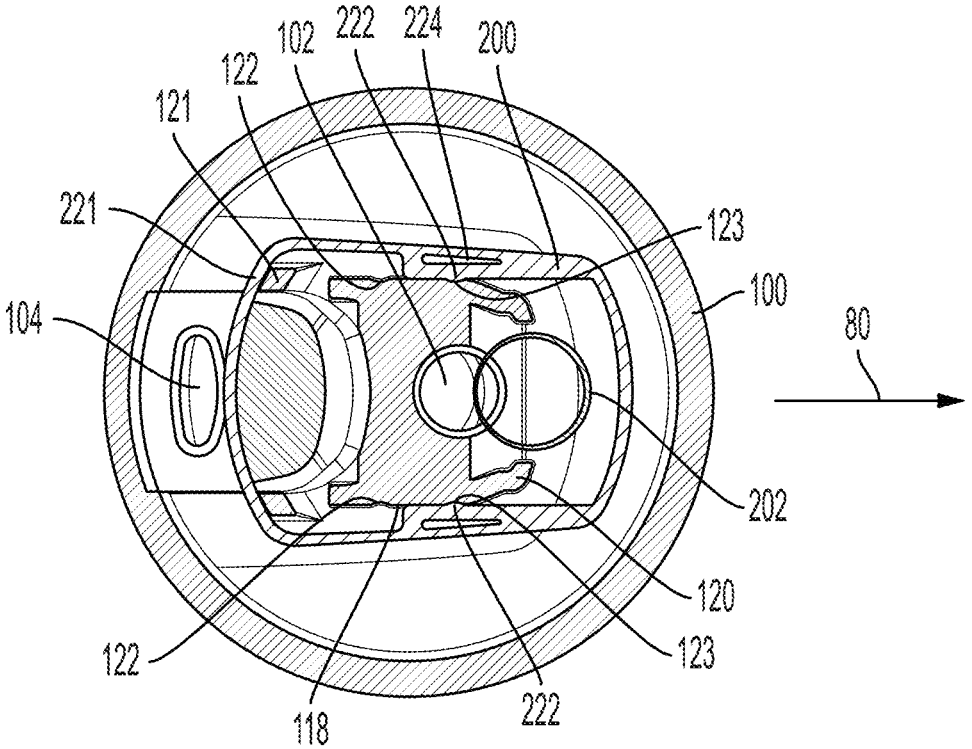
FIG. 11 shows a sectional view of a portion of the beverage container of FIG. 1 taken along line 10-10 of FIG. 4 with the selector in the second position.

FIGS. 10 and 11 are horizontal cross-sectional views showing relative positions of certain components of beverage container 10 during operation. These figures illustrate portions of lid base 100 and selector 200 when selector 200 is in its first position (FIG. 10) and its second position (FIG. 11).

As mentioned, in some embodiments, lid 20 may include registration features to hold selector 200 in its first position or second position and/or to provide tactile and/or audible feedback to a user when sliding selector 200. For example, as shown in FIG. 10, lid base 100 may include recesses 122, 123 and selector 200 may include registration bumps 222. As shown, for example in FIG. 9, recesses 122, 123 may be provided in channel 114, and registration bumps 222 may extend from flange 214.

When selector 200 is in its first position relative to lid base 100, as shown in FIG. 10, registration bumps 222 of selector 200 are registered within recesses 122 of lid base 100. This registration helps inhibit inadvertent movement (e.g., forward or rearward translation) of selector 200 relative to lid base 100.

In FIG. 11, selector 200 has been moved (e.g., linearly translated) from the position shown in FIG. 10. Now, registration bumps 222 are received within recesses 123 of lid base 100. In traveling to this location, registration bumps 222 pressed against a side of channel 114, thereby resiliently deforming flanges 214 of selector 200 until registration bumps 222 and recesses 123 were aligned. Once registration bumps 222 and recesses 123 were aligned, registration bumps 222 sprung into recesses 123. The springing movement of registration bump 222 into recess 123 may be felt, heard, or both by a user, and thus can provide tactile feedback, audible feedback, or both so that the user knows that lid 20 is aligned in a particular mode. Registration bumps 222, sides 118 of channels 114, and recesses 122, 123 interact similarly as selector 200 is moved from the position shown in FIG. 11 to the position shown in FIG. 10. In some embodiments, sides 118 of channels 114 or registration bumps 222 may deform, instead of or in addition to flanges 214, to provide the described registration.

In the illustrated embodiment, registration bumps 222 and recesses 122, 123 are positioned such that multiple registration bumps 222 and recesses 122, 123 align simultaneously. However, in other embodiments, only a single registration bump 222 and recess 122, 123 may align at once. In some embodiments, each registration bump 222 is disposed directly across from another registration bump 222 (e.g., relative to axis 70), and each recess 122, 123 is disposed directly across from another recess 122, 123 (e.g., relative to axis 70). Such even positioning can help promote even feedback and an even feel to a user sliding selector 200.

In the illustrated embodiment, when selector 200 is in its first position, rear recesses 123 do not have registration bumps received therein, and when selector 200 is in its second positon, front recesses 122 do not have registration bumps received therein. However, additional registrations bumps may be provided and received in rear recesses 123 when selector 200 is in its first position and/or in front recesses 122 when selector 200 is in its second position.

The registration features of lid base 100 and selector 200 are not limited to the arrangement shown in the figures. For example, in the illustrated embodiment, lid base 100 includes recesses and selector 200 includes registration bumps. However, selector 200 may include recesses and lid base 100 may include registration bumps. Also, for example, in the illustrated embodiment, registration bumps 222 extend horizontally. However, in other embodiments, registration bumps may extend vertically or in another direction.

In some embodiments, selector 200 includes a cutout 224 so that flange 214 can deflect near registration bump 222, thereby allowing registration bump 222 to move out of recesses 122, 123 and along channel 114. In other embodiments, flange 214 and/or channel 114 may be made of a compliant material so that flange 214 and/or channel 114 can deflect near registration bump 222.

In some embodiments, lid base 100 may include a stop 120 extending up from dividing platform 108. In some configurations, stop 120 may cooperate with, for example, by abutting engagement, a wall 220 of selector 200 to inhibit movement of selector 200 with respect to lid base 100 (i.e., to inhibit selector 200 from moving past stop 120). For example, as shown in FIG. 10, when selector 200 is in its first position, wall 220 of selector 200 contacts stop 120, thereby inhibiting selector 200 from moving in direction 70. In the illustrated embodiment, selector 200 is further inhibited from moving in direction 70 by an interaction between a front edge 225 of selector 200 and an inner edge 125 of lid base 100.

In some embodiments, lid base 100 may include a stop 121 extending up from dividing platform 108. In some configurations, stop 121 may cooperate with, for example, by abutting engagement, a wall 221 of selector 200 to inhibit movement of selector 200 with respect to lid base 100 (i.e., to inhibit selector 200 from moving past stop 121). For example, as shown in FIG. 11, when selector 200 is in its second position, wall 221 of selector 200 contacts stop 121, thereby inhibiting selector 200 from moving in direction 80.

As mentioned, in some embodiments, selector 200 may be removable from lid base 100. This may, for example, allow a user to more easily clean lid 20 and its components. In such embodiments, selector 200 may be movable past stop 121 into a disassembly position. For example, in the illustrated embodiment, a user may apply a force in direction 80 to push selector 200 past stop 121 into a disassembly position. In some embodiments, a user may encounter greater resistance when moving selector 200 from the second position to the disassembly position than when moving selector 200 from the first position to the second position and from the second position to the first position.

In the disassembly position, flanges 214 of selector 200 are not vertically engaged with receiving channels 114 of lid base 100, which allows the user to disassemble lid 20 by vertically removing selector 200. In turn, removing selector 200 vertically frees sealing member 300 for removal from its position between selector 200 and lid base 100.

As discussed above, lid 20 can be formed of four unitary components: lid base 100, selector 200, sealing member 300, and outer gasket 400. By utilizing unitary components in such a way as has been described above, assembly and disassembly by a user can be simply and intuitively achieved. The user will benefit from having a small number of parts to disassemble, wash, and reassemble. The construction described above also allows each part to be formed large enough that it is easy for a user to keep track of and not to inadvertently lose during such disassembly and washing.

It is to be appreciated that the Detailed Description section, and not the Summary and Abstract sections, is intended to be used to interpret the claims. The Summary and Abstract sections may set forth one or more but not all exemplary embodiments of the disclosed invention(s) as contemplated by the inventor(s), and thus, are not intended to limit the disclosed invention(s) and the appended claims in any way.

The foregoing description of the specific embodiments will so fully reveal the general nature of the claimed invention that others can, by applying knowledge within the skill of the art, readily modify and/or adapt for various applications such specific embodiments, without undue experimentation, without departing from the general concept of the claimed invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the claimed invention should not be limited by any of the above-described exemplary embodiments, but should be defined only in accordance with the claims and their equivalents.

What is claimed is:

1. A lid for a beverage container, the lid comprising:
a first drinking opening;
a second drinking opening;
a selector comprising an opening, the selector configured to linearly slide between a first position in which the first drinking opening is accessible and the second drinking opening is inaccessible, and a second position in which the second drinking opening is accessible and the first drinking opening is inaccessible,
wherein in the first position:
the selector is positioned over and seals the second drinking opening, and
the opening of the selector is aligned with the first drinking opening, and
wherein, in the second position:
the selector is not positioned over the second drinking opening, and
the opening of the selector is offset from the first drinking opening.

2. The lid of claim 1, wherein the opening of the selector is selectively closed by a one-way valve configured to receive a straw therethrough.

3. The lid of claim 2, wherein when the one-way valve is closed, the lid is sealed against the passage of liquid therethrough.

4. The lid of claim 2, wherein the one-way valve is a cross-slit valve.

5. The lid of claim 1, wherein the lid is configured to dispense a beverage through the first drinking opening into a user's mouth via a straw inserted through the first drinking opening, and
wherein the lid is configured to dispense a beverage through the second drinking opening directly into a user's mouth.

6. The lid of claim 1, wherein the first drinking opening is nearer to a center of the lid than is the second drinking opening.

7. The lid of claim 1, wherein the selector comprises:
a first sealing portion that contacts the lid around a periphery of the second drinking opening when the selector is in the first position, and
a second sealing portion comprising a one-way valve over the first drinking opening when the selector is in the first position.

8. The lid of claim 1, wherein the lid further comprises a lid base,
wherein the first drinking opening extends through the lid base,
wherein the second drinking opening extends through the lid base, and
wherein when the selector is engaged with the lid base, motion of the selector relative to the lid base is constrained to linear motion.

9. The lid of claim 8, wherein the direction of the linear motion of the selector is perpendicular to an axis of the first drinking opening.

10. The lid of claim 1, wherein the lid further comprises a lid base,
wherein the selector is configured to slide relative to the lid base between the first position and the second position,
wherein, when the selector is in the first position or the second position, registration features of the selector and of the lid base cooperate to resist sliding of the selector relative to the lid base.

11. The lid of claim 10, wherein the registration features comprise a detent mechanism.

12. The lid of claim 10, wherein the registration features comprise:
on one of the selector and the lid base, a protrusion; and
on the other of the selector and the lid base, at least two recesses spaced apart in the direction of travel of the selector relative to the lid base,
wherein in the first position the protrusion is received into one of the at least two recesses, and
wherein in the second position the protrusion is received into another of the at least two recesses.

13. The lid of claim 1, wherein the lid further comprises a lid base,
wherein the selector is configured to slide relative to the lid base between the first position, the second position, and a third position, and
wherein, in the third position the selector is removable from the lid base.

14. The lid of claim 13, further comprising registration features of the selector and of the lid base,
wherein the registration features cooperate to resist sliding of the selector relative to the lid base when the selector is in one of the first position or the second position.

15. The lid of claim 14, wherein the resistance is greater from the second position to the third position than from the first position to the second position and from the second position to the first position.

16. The lid of claim 1, wherein the lid further comprises a lid base,
wherein the first drinking opening extends through the lid base,
wherein the second drinking opening extends through the lid base, and
wherein the selector is removable from the lid base.

17. The lid of claim 16, wherein the selector comprises a sealing member, wherein the sealing member contacts the lid around a periphery of the second drinking opening when the selector is in the first position, and wherein the sealing member extends around the first drinking opening when the selector is in the first position, and wherein the sealing member is removable from the selector.

18. The lid of claim 1, wherein the selector opening is the only opening through the selector.

19. A beverage container, comprising:

the lid of claim 1; and a vessel, wherein the lid is configured to attach to and close an opening of the vessel, to contain a beverage therein.

20. A lid for a beverage container, the lid comprising:

a first drinking opening;

a second drinking opening;

a selector comprising an opening, the selector configured to linearly slide between a first position in which the first drinking opening is accessible through the selector opening and the second drinking opening is inaccessible, and a second position in which the second drinking opening is accessible outside of the selector and the first drinking opening is inaccessible.

21. The lid of claim 20, wherein the opening of the selector is selectively closed by a one-way valve configured to receive a straw therethrough.

22. The lid of claim 20, wherein the first drinking opening is nearer to a center of the lid than it is to an outer edge of the lid.

23. The lid of claim 22, wherein the second drinking opening is nearer to an outer edge of the lid than the first drinking opening is to the outer edge of the lid.

24. The lid of claim 20, further comprising a rim, wherein the selector is positioned within the rim in the first position and in the second position.

25. A lid for a beverage container, the lid comprising:

a first drinking opening;

a second drinking opening;

a selector comprising an opening, the selector configured to linearly slide between a first position in which the first drinking opening is accessible and the second drinking opening is inaccessible, and a second position in which the second drinking opening is accessible and the first drinking opening is inaccessible, and wherein the selector comprises a first sealing portion that seals the second drinking opening when the selector is in the first position, and a second sealing portion comprising a one-way valve over the first drinking opening when the selector is in the first position.

* * * * *